US011512470B1

(12) United States Patent
Cramer

(10) Patent No.: US 11,512,470 B1
(45) Date of Patent: Nov. 29, 2022

(54) STACKABLE REBAR CHAIR

(71) Applicant: OCM Inc., Grayslake, IL (US)

(72) Inventor: Andy Cramer, Johnsburg, IN (US)

(73) Assignee: OCM Inc, Grayslake, IL (US)

( * ) Notice: Subject to any disclaimer, the term of this patent is extended or adjusted under 35 U.S.C. 154(b) by 0 days.

(21) Appl. No.: 17/458,912

(22) Filed: Aug. 27, 2021

(51) Int. Cl.
*E04C 5/16* (2006.01)

(52) U.S. Cl.
CPC ..... *E04C 5/168* (2013.01); *E04C 5/166* (2013.01)

(58) Field of Classification Search
CPC ..... E04C 5/168; E04C 5/167; E04C 5/166; E04C 5/18; E04C 5/20
See application file for complete search history.

(56) References Cited

U.S. PATENT DOCUMENTS 3,830,032 A * 8/1974 Robb ..... E04C 5/206 52/687
4,060,954 A * 12/1977 Liuzza ..... E04C 5/168 52/309.1
6,089,522 A * 7/2000 Haslem ..... E04C 5/206 404/136
D548,056 S * 8/2007 Erickson ..... D8/354
7,810,298 B1 10/2010 Sorkin
9,115,492 B2 8/2015 Parham
D838,576 S * 1/2019 Cramer ..... D8/354
2007/0193189 A1 8/2007 Bennett et al.
2008/0028718 A1* 2/2008 Erickson ..... E04C 5/206 52/687
2012/0247058 A1 10/2012 Alfonso
2019/0284806 A1 9/2019 Ostergar

OTHER PUBLICATIONS

Polylock, Innovations in precast Drainage and Wastewater products, Jun. 2021, 3 pages, Polylock Inc, Wallingford CT, USA.
General Technologies, Inc., GTI Composite Stack Chairs, Jun. 2021, 4 pages, General Technologies Inc., Texas, USA.
Patterson, Stack Chairs—Standard and heavy Duty, Jun. 2021, 1 page, Patterson Plastics & Manufacturing, Fallington PA, USA.

* cited by examiner

*Primary Examiner* — Adriana Figueroa
(74) *Attorney, Agent, or Firm* — Liell + McNeil

(57) ABSTRACT

A stackable rebar chair includes a one-piece body of molded plastic that includes four vertical support legs and four vertical leg receiving sockets. The one-piece body also includes first and second concave rebar cradles that are oriented perpendicular to each other. Each of the support legs has a cross section that defines a first polygon, and each of the leg receiving sockets defines a partial second polygon that is both larger, and differently shaped, that the first polygon. When the rebar chairs are stacked, the four supporting legs of the upper chair are received in the leg receiving sockets of the lower chair in such a manner that a plurality of vertices of the first polygon are positioned, shaped and oriented to simultaneously match respective vertices of the partial second polygon.

17 Claims, 6 Drawing Sheets

STACKABLE REBAR CHAIR

TECHNICAL FIELD

The present disclosure relates generally to rebar chairs used in supporting rebar in concrete forms, and more particularly a stackable rebar chair that gives a user more versatility in setting the height of rebar in a given concrete forming application.

BACKGROUND

Rebar chairs are devices used to support rebar in a concrete form while concrete is being poured into the form to create reinforced concrete. Rebar chairs are usually formed of metal or plastic and often come in various heights to allow the user to support rebar at different selected heights in a concrete form. More recently, stackable rebar chairs have become available, and provide users with even more versatility in setting rebar height in various concrete work. For instance, one such stackable rebar chair is shown in United States Patent Application Publication 2008/0028718. Other stackable rebar chairs are also known and commercially available. However, they all suffer from various drawbacks that undermine strength, versatility, stackability and stability. For instance, the stackable rebar chair identified above can suffer from stability issues because the circular mating structure permits a stack of chairs to twist about their shared vertical axis, sometimes leading to collapse or other undesirable outcomes.

The present disclosure is directed toward one or more of the problems set forth above.

SUMMARY OF THE DISCLOSURE

In one aspect, a stackable rebar chair includes a one-piece body of molded plastic that defines a vertical centerline and includes four vertically oriented support legs. The one-piece body also includes four vertically oriented leg receiving sockets, a first concave rebar cradle, and a second concave rebar cradle oriented perpendicular to the first concave rebar cradle. Each of the four vertically oriented support legs are identical, and a cross section perpendicular to the vertical centerline defines a first polygon with a plurality of vertices. The four vertically oriented leg receiving sockets are identical, and each defines a partial second polygon that is larger, and differently shaped, than the first polygon. Less than all of the plurality of vertices of the first polygon are positioned, shaped and oriented to simultaneously match respective vertices of the partial second polygon when the first polygon is positioned inside the partial second polygon, such as what would occur when two of the stackable rebar chairs are stacked atop one another.

In another aspect, a stack of stackable rebar chairs includes a first rebar chair that consists of a one-piece body of molded plastic that defines a vertical centerline and includes four vertically oriented support legs. The one-piece body also includes four vertically oriented leg receiving sockets, a first concave rebar cradle, and a second concave rebar cradle oriented perpendicular to the first rebar cradle. A second rebar chair consists of a one-piece body of molded plastic that defines a vertical centerline and includes four vertically oriented support legs. The one-piece body also includes four vertically oriented leg receiving sockets, a first concave rebar cradle, and a second concave rebar cradle oriented perpendicular to the first concave rebar cradle. The second rebar chair is mated to, supported by, and positioned directly atop the first rebar chair. Each of the four vertically oriented support legs of the second rebar chair is received in a respective one of the four vertically oriented leg receiving sockets of the first rebar chair. A plurality of planar surfaces of each of the four vertically oriented support legs of the second rebar chair are in contact with respective planar surfaces that define portions of the respective one of the four vertically oriented leg receiving sockets of the first rebar chair.

DETAILED DESCRIPTION

Figure 4:
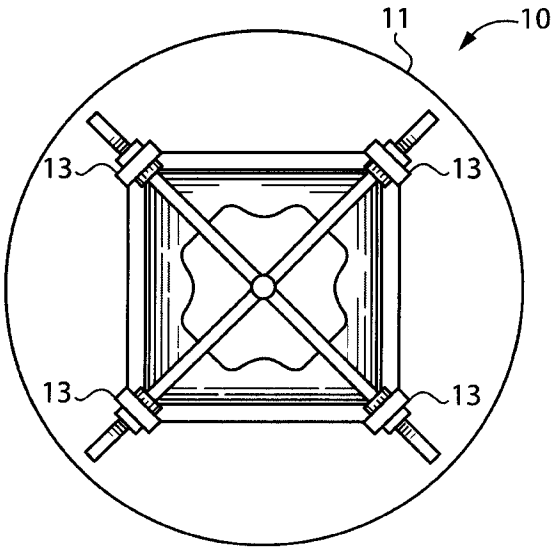
FIG. 4 is a bottom view of the stackable rebar chair of FIG. 1.
Figure 3:
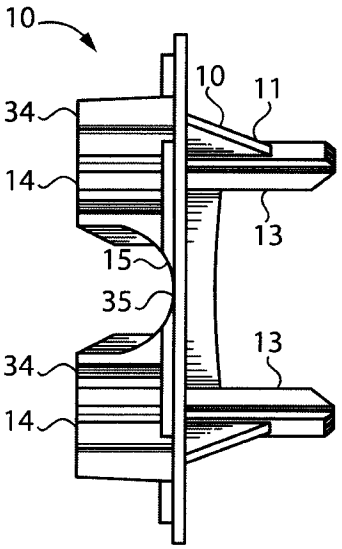
FIG. 3 is a right side view of the stackable rebar chair of FIG. 1.
Figure 1:
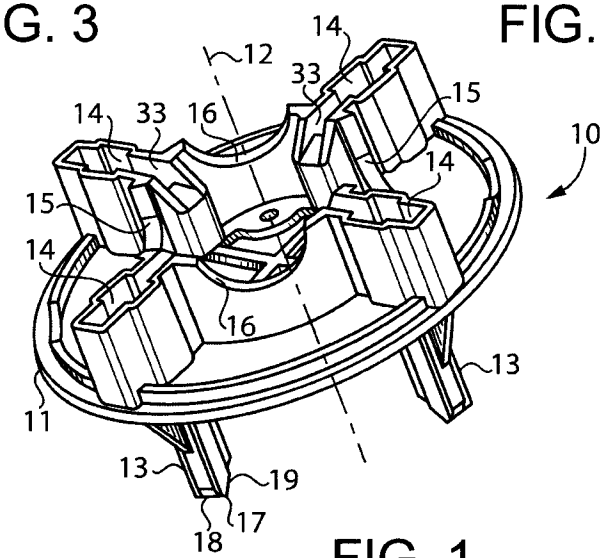
FIG. 1 is a perspective view of a stackable rebar chair according to one embodiment of the present disclosure.
Figure 2:
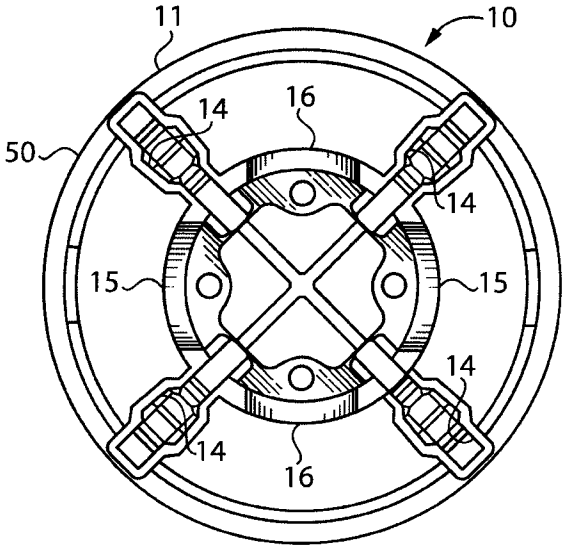
FIG. 2 is a top view of the stackable rebar chair of FIG. 1.
Figure 5:
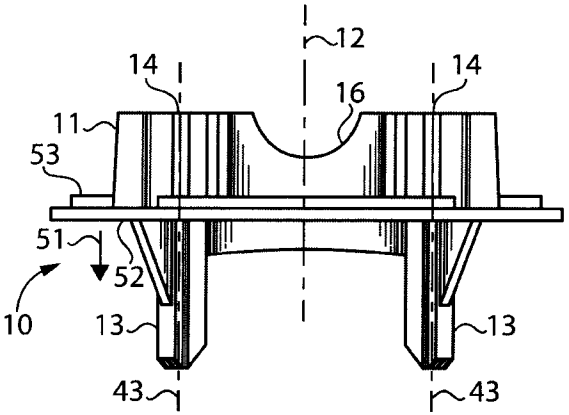
FIG. 5 is a front side view of the stackable rebar chair of FIG. 1.
Figure 9:
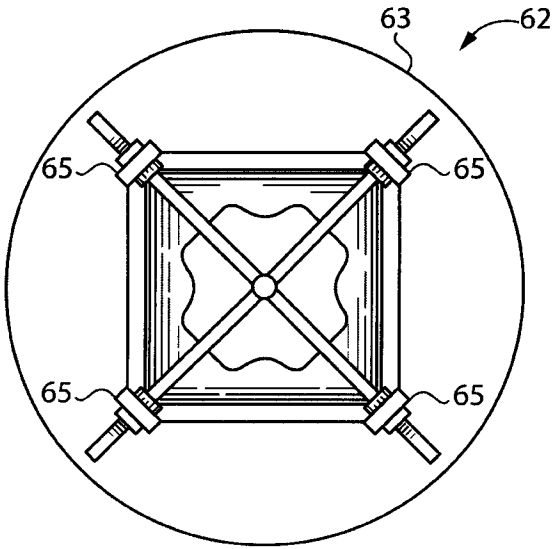
FIG. 9 is a bottom view of the view of the stackable rebar chair of FIG. 6.
Figure 8:
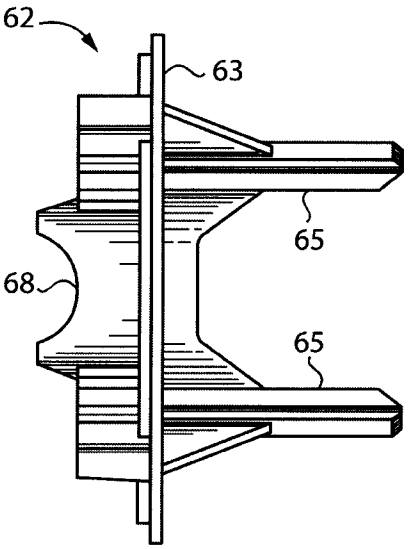
FIG. 8 is a right side view of the stackable rebar chair of FIG. 6.
Figure 6:
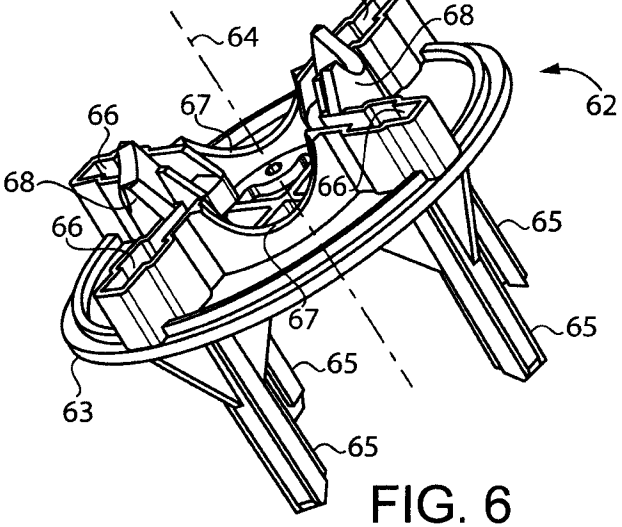
FIG. 6 is a perspective view of a taller stackable rebar chair according to the present disclosure.
Figure 7:
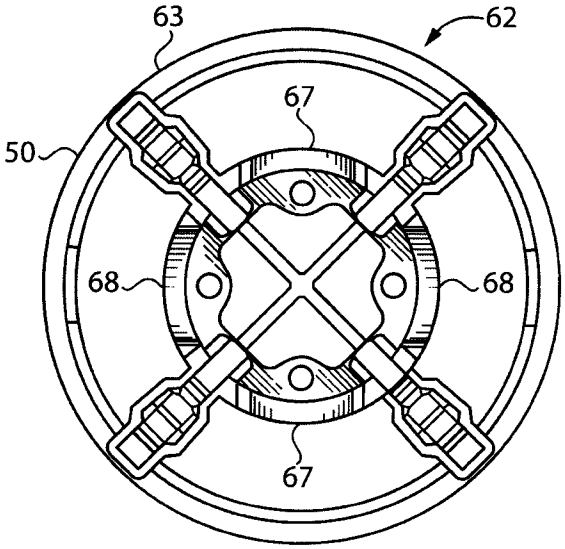
FIG. 7 is top view of stackable rebar chair of FIG. 6.
Figure 10:
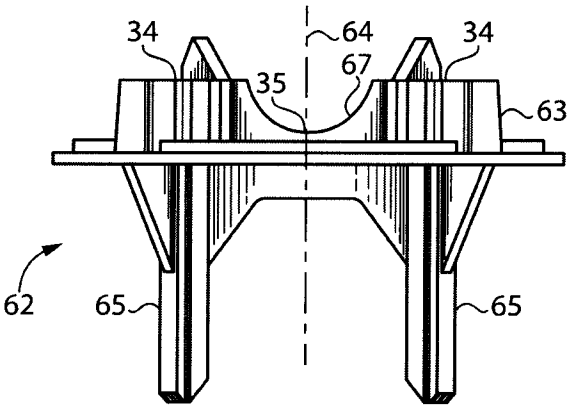
FIG. 10 is a front side view of the stackable rebar chair of FIG. 6.
Figure 11:
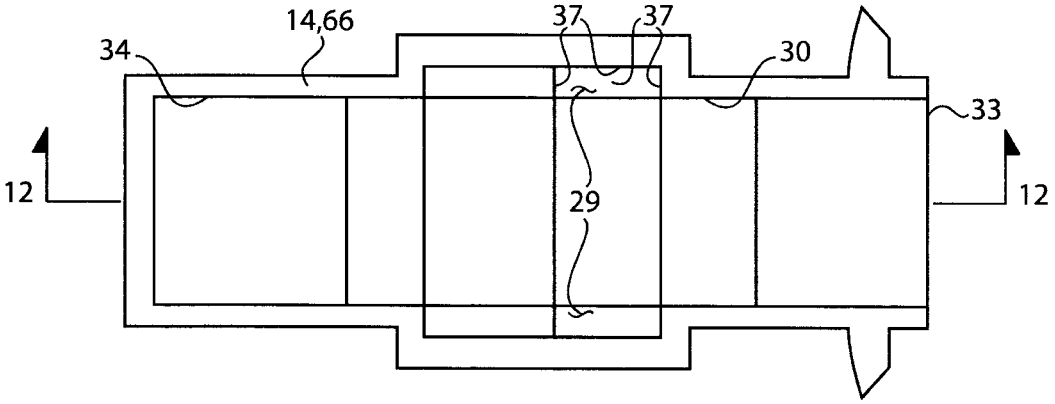
FIG. 11 is an enlarged top view of a leg receiving socket for the stackable rebar chairs of FIG. 1 and FIG. 6.

Referring initially to FIGS. 1-5, a stackable rebar chair 10 consists of a one-piece body 11 of molded plastic that defines a vertical centerline 12 and includes four vertically oriented support legs 13. One-piece body 11 also includes four vertically oriented leg receiving sockets 14, a first concave rebar cradle 15, and a second concave rebar cradle 16 oriented perpendicular to the first concave rebar cradle 15. The concave rebar cradles 15 and 16 each include two spaced apart upward oriented U shaped surfaces that are continuous and of a larger diameter than rebar, with the U shape naturally urging any supported rebar to the lowest point of the U. The top of the upturn sides of the rebar cradles are at a vertical distance along the centerline about equal to the diameter of rebar. The term "about equal" means that a ratio of the two dimensions when rounded to a single integer, is the integer one. The one-piece body 11 includes a stiffening disc 50 that is oriented perpendicular to the vertical centerline 12. The four vertically oriented support legs 13 extend in one direction 51 away from one side 52 of the stiffening disc 50. The four vertically oriented leg receiving sockets 14 are located entirely on an opposite side 53 of the stiffening disc 50. Each of the four vertically oriented leg receiving sockets 14 have openings 34 located higher on the vertical centerline 12 than a respective low point 35 of the first concave rebar cradle 15. Openings 34 open directly opposite to the leg direction 51.

Figure 15:
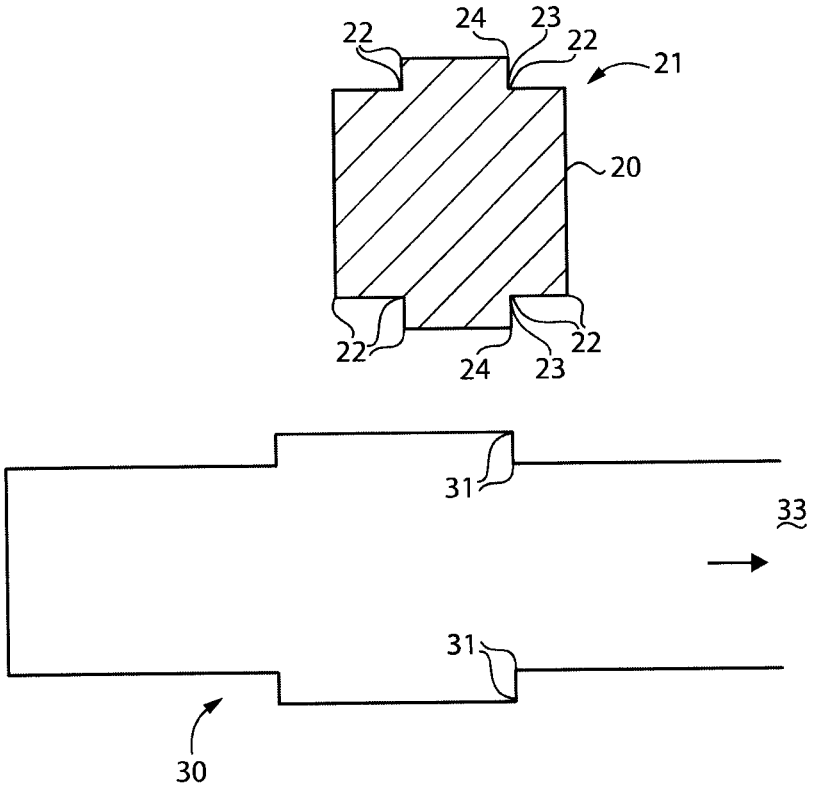
FIG. 15 is a view of the first polygon and a partial second polygon defined by a leg and a socket according to one aspect of the present disclosure.

Referring now in addition to FIG. 15, each of the four vertically oriented support legs 13 are identical, and a cross-section 20 perpendicular to the vertical centerline 12 defines a first polygon 21 with a plurality of vertices 22. In the illustrated embodiment, the first polygon 21 includes twelve vertices 22, six of which may be characterized as concave vertices 23, and the remaining six vertices 22 can be characterized as convex vertices 24. The four vertically oriented leg receiving sockets 14 are also identical to each other, and each defines a partial second polygon 30 that is both larger, and differently shaped, than the first polygon 21. As used in this disclosure, the phrase "partial second polygon" means that exactly one side is missing from what would otherwise be a full polygon, as in first polygon 21. In this case, the partial second polygon 31 is missing a side 33 that would otherwise create a closed perimeter at a side closest to vertical centerline 12. Less than all of the vertices 22 of the first polygon 21 are positioned, shaped and oriented to simultaneously match respective vertices 31 of the partial second polygon 30 when two rebar chairs 10 are stacked atop one another with the four legs of the upper rebar chair received in the sockets of the lower rebar chair. In the illustrated example, all 12 vertices 22 of the first polygon 21 are right angle vertices, but other polygons would also fall within the scope of the present disclosure, including those that included no right angle vertices. Thus, in the example stackable rebar chair 10, the less than all vertices of the first polygon associated with the legs that match respective vertices 31 of the partial second polygon of the sockets will necessarily include a plurality of right angles.

Referring now to FIGS. 6-10, a stackable rebar chair 62 is nearly identical to stackable rebar chair 10 except second stackable rebar chair 62 is taller with longer legs. Like the earlier embodiment, second rebar chair 62 consists of a one-piece body 63 of molded plastic that defines a vertical centerline 64 and includes four vertically oriented support legs 65. In addition, the one-piece body 63 includes four vertically oriented leg receiving sockets 66, a first concave rebar cradle 67, and a second concave rebar cradle 68 oriented perpendicular to the first concave rebar cradle 67. Preferably, the legs 65 and sockets 66 have identical shapes and sizes as those described earlier with regard to stackable rebar chair 10 so that chair 62 may be stacked onto rebar chair 10, or vice versa, with the four legs of the one chair being received in the four sockets of the other chair.

Figure 12:
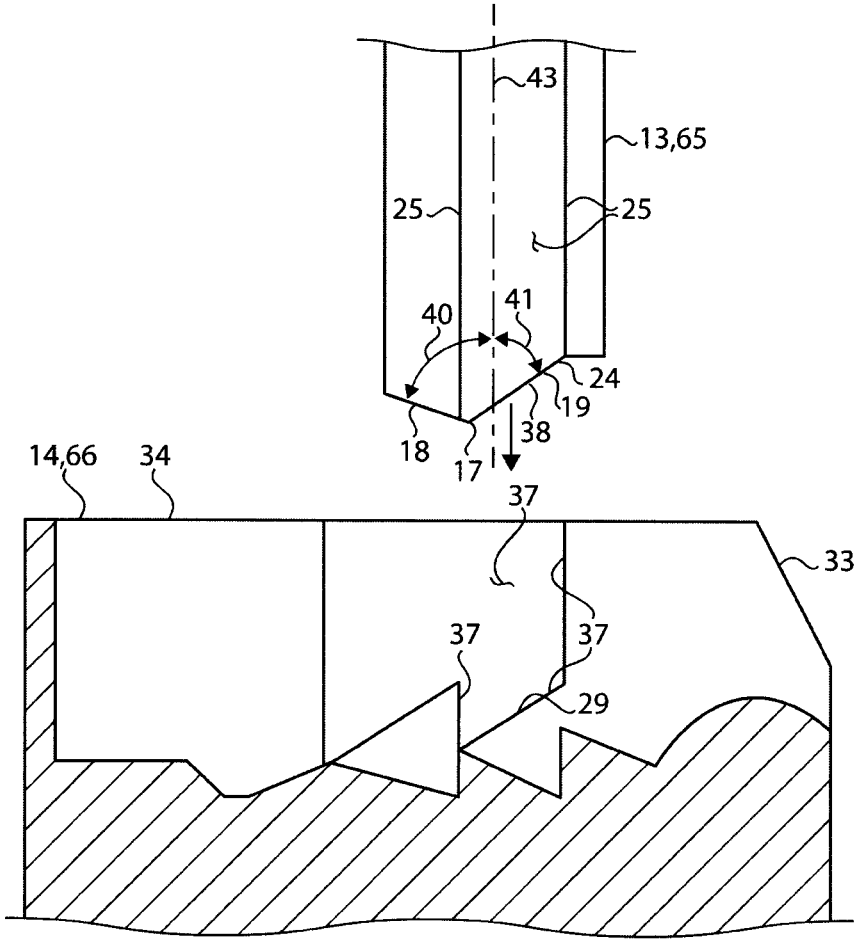
FIG. 12 is a section view through the socket of FIG. 11 along section lines 12-12 of FIG. 11, and also showing a leg of another stackable rebar chair moving toward the leg receiving socket.

Referring now to FIGS. 11-15, close-up views show the interaction between the legs 13, 65 and their counterpart sockets 14, 66 of the different height rebar chairs 10, 62. FIG. 12 shows that the vertically oriented support legs 13, 65 may terminate at a corner line 17 where a first slanted surface 18 meets a second slanted surface 19, with the corner line 17 oriented perpendicular to the vertical centerline 12 of the one-piece body 11, 63. Each of the vertically oriented support legs 13, 65 may be thought of as defining its own centerline 43 that is parallel to the vertical centerline 12, 64 of rebar chair 10, 62. In addition, these individual leg centerlines 43 will inherently intersect a nearly enclosed region defined by a respective one of the partial second polygons 30 which are in turn defined by the leg receiving sockets 14, 66. As best shown in FIG. 12, the first and second slanted surfaces 18, 19 are oriented at respective angles 40 and 41 with respect to the leg 43, with each of these angles 40, 41 being greater than zero and less than 90 degrees.

Figure 13:
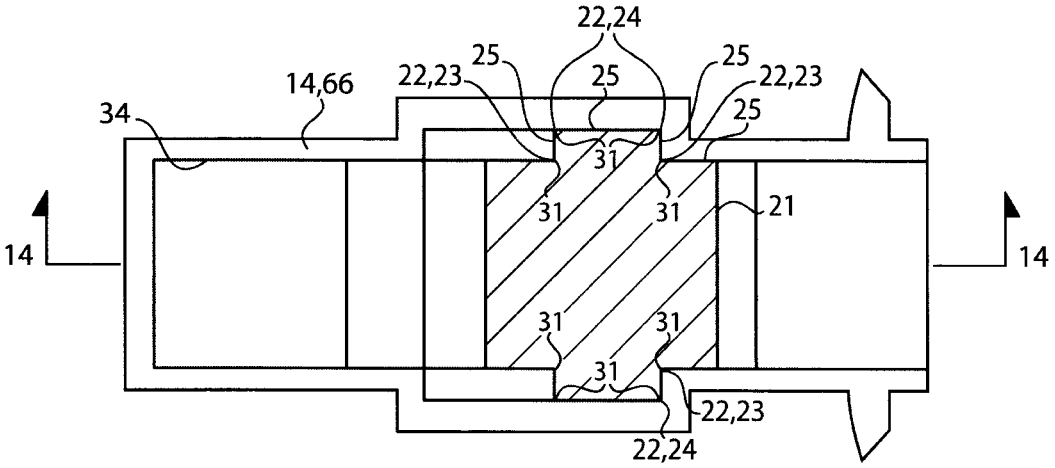
FIG. 13 is a view of a leg receiving socket similar to FIG. 11 except showing the polygon shape of a leg received therein.
Figure 14:
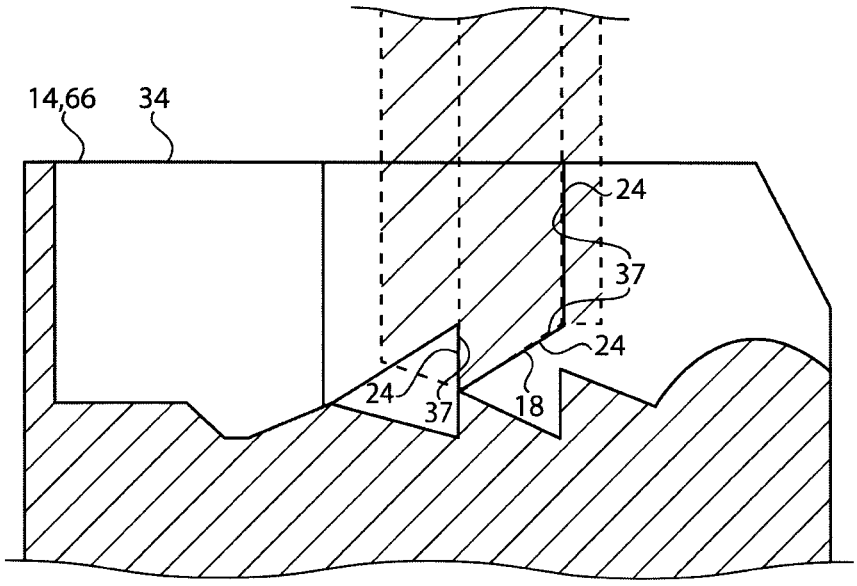
FIG. 14 is a section view through the leg and socket of FIG. 13 as viewed along section lines 14-14 of FIG. 13.
Figure 16:
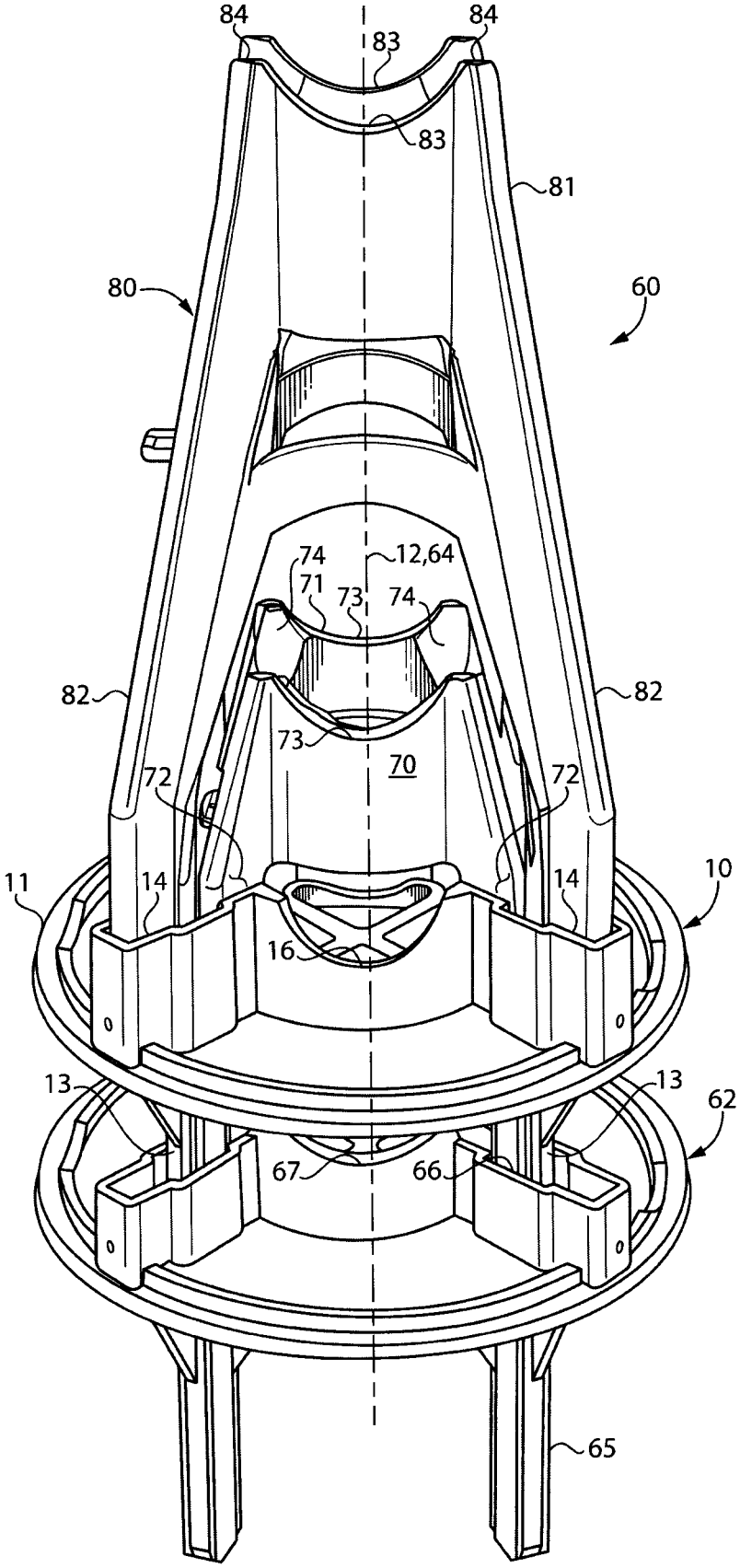
FIG. 16 is a perspective view of a stack of stackable rebar chairs according to another embodiment of the present disclosure.

Referring now in addition to FIG. 16, a stack 60 of stackable rebar chairs includes a first rebar chair 62 at the bottom. A second rebar chair 10 is mated to, supported by and positioned directly atop the first rebar chair 62. Each of the four vertically oriented support legs 13 of the second rebar chair 10 is received in a respective one of the four vertically oriented leg receiving sockets 66 of the first rebar chair 62. When this mating of the two chairs occurs, a plurality of planar surfaces 25 of each of the vertically oriented support legs 65 are in contact with respective planar surfaces 37 that define portions of the respective one of the four vertically oriented leg receiving sockets 14 of the first rebar chair 62. In addition, at least four right angle vertices 23, 24 of the second rebar chair legs 65 match respective vertices 31 of the partial second polygon 30 of the first rebar chair 10, as best shown in FIGS. 13 and 14. FIG. 14 is also of interest for showing that one of the slanted surfaces 18 contacts a counterpart planar surface 37 in the respective socket 14, 66 when the respective leg 13, 65 is fully received in the counterpart socket 14, 66. In addition, when this occurs another vertical planar surface 38 contacts a counterpart planar surface 37 located near the bottom of the respective socket 14, 66 as shown in FIG. 14. Thus, in the illustrated embodiment, when a leg is received in a socket, four vertices 22 simultaneously match and engage counterpart vertices 41 of the respective socket adjacent the opening 34 to the socket, and eight additional vertices 23, 24 simultaneously engage similar matching vertices 31 defined toward the bottom of the respective socket 14, 66. Thus, of the twelve vertices defined by the first polygon 21, eight of those vertices match with counterpart vertices defined by the leg receiving socket 14, 66. This feature inhibits different chairs in a vertical stack from twisting with respect to other chairs about their shared vertical axis 12, 64. This is to be contrasted with stacking rebar chairs with legs having a circular cross section received in cylindrical bores that can permit rotation of its legs in its respective socket permitting twisting of an entire stack of rebar chairs could result in breakage or another undesirable outcome.

Because of the versatility provided by the large elongated leg receiving sockets 14, 66, each of the stacking rebar chairs 10, 62 may accommodate other rebar chairs as shown in FIG. 16 to provide a user with even greater versatility. Thus, as shown in FIG. 16, a third rebar chair 70 consist of a one-piece body 71 of molded plastic that includes four support legs 72, a first concave rebar cradle 73 and a second concave rebar cradle 74 oriented perpendicular to the first concave rebar cradle. Each of the four support legs 72 is closer to the vertical centerline 12, 64 than each of the four vertically oriented support legs 14, 65 of the first and second rebar chairs 10, 62, respectively. The legs 72 of the third rebar chair 70 are closer to the vertical centerline 12, 64 than each of the four vertically oriented support legs 13, 65 of the stackable rebar chairs 10 and 62. Thus, the legs 72 of the third rebar chair 70 are positioned in the portion of the respective leg receiving sockets 66 at a location closer to the centerline 12, 64. This inner portion of the sockets 14,66 is shaped to match and engage counterpart vertices and surfaces associated with the leg 72 of the third rebar chair 70. The sockets 14, 66 define a partial second polygon 30 to accommodate the shorter rebar chairs 70. The third rebar chair is mated to, supported by and positioned directly atop the second rebar chair 10. The elongated leg receiving sockets 14 and 66 also permit receipt of taller rebar chairs, such as fourth rebar chair 80. Like the earlier rebar chairs, fourth rebar chair 80 consists of a one-piece body 81 of molded plastic that includes four support legs 82, a first concave rebar cradle 83, and a second concave rebar cradle 84 that is oriented perpendicular to the first rebar concave cradle 83. Each of the four support legs 82 is further from the vertical centerline 12, 64 than the four vertically oriented support legs 13, 64 of both the first and second rebar chair 10 and 62, respectively. The fourth rebar chair 80 is mated to, supported by, and positioned directly atop the second rebar chair 10. In addition, the respective leg receiving sockets 66 preferably have counterpart vertices and surfaces that engage surfaces on the respective legs 82 of the fourth rebar chair to also inhibit relative twisting about vertical axis 12, 64. Thus each of the four support legs 82 of the fourth rebar chair 80 is received in a respective one of the four vertically oriented leg receiving sockets 14 of the second rebar chair 10. Also of note is the fact that second rebar chair 10 simultaneously securely supports and is mated to different height rebar chairs 70 and 80.

INDUSTRIAL APPLICABILITY

The present disclosure finds general applicability where rebar is to be positioned in a concrete mold, such as for making reinforced concrete slabs. The present disclosure also finds application in cases where the base surface upon which the rebar chairs are positioned is either irregular, slanted or otherwise not horizontal so that different height chairs may be necessary to position the rebar in the concrete mold in a horizontal orientation. Furthermore, the stackable rebar chairs of the present disclosure finds specific application in cases where two or more layers of rebar at different heights are needed to be positioned according to a specific application. Thus in a stack 60 of rebar chairs according to the present disclosure, any of the chairs 10, 62, 70, 80 in the stack may be able to support rebar or merely act as spacer to support rebar chairs above themselves. The various vertices and surfaces that interact when legs of stackable rebar chairs are received in sockets of another chair interact to prevent twisting of a stack of rebar chairs about a vertical axis 12, 64 to provide greater stability that could avoid breakage or other undesirable outcomes associated with stackable rebar chairs that utilize circular legs.

The present description is for illustrative purposes only, and should not be construed to narrow the breadth of the present disclosure in any way. Thus, those skilled in the art will appreciate that various modification might be made to the presently disclosed embodiments without departing from the full and fair scope and spirit of the present disclosure. Other aspects, features and advantages will be apparent upon an examination of the attached drawings and appended claims.

FEATURE LIST

10 is stackable rebar chair
11 One-piece body
12 vertical centerline
13 Vertically oriented support legs
14 Vertically oriented leg receiving socket
15 Concave rebar cradle
16 Concave rebar cradle
17 As corner line
18 Slanted surface
19 Slanted surface
20 Cross-section
21 First polygon
22 Vertices
23 Concave vertices
24 Convex vertices
25 Planar surfaces
29 Counterpart slanted surface
30 Partial second polygon
31 Vertices
33 One side
35 Low point
37 Planar surface
38 Slanted surface
40 Angle
41 Angle
43 Centerline
50 Stiffening disc
51 Direction
52 One side
53 Opposite side
60 Stack
62 Second rebar chair
63 One-piece body
64 Vertical centerline
65 Vertically oriented support legs
66 Leg receiving socket
67 Rebar cradle
68 Rebar cradle
70 Third rebar chair
71 One-piece body
72 Support leg
73 Concave rebar cradle
74 Concave rebar cradle
80 Fourth rebar chair
81 One-piece body
82 Support leg
83 Concave rebar cradle
84 Concave rebar cradle

What is claimed is:

1. A stackable rebar chair comprising:

a one-piece body of molded plastic that defines a vertical centerline and includes four vertically oriented support legs, four vertically oriented leg receiving sockets, a first concave rebar cradle, and a second concave rebar cradle oriented perpendicular to the first concave rebar cradle;

each of the four vertically oriented support legs are identical, and a cross section perpendicular to the vertical centerline defines a first polygon with a plurality of vertices;

the four vertically oriented leg receiving sockets are identical, and each defines a partial second polygon that is both larger, and differently shaped, than the first polygon; and less than all of the plurality of vertices of the first polygon are positioned, shaped and oriented to simultaneously match respective vertices of the partial second polygon when the first polygon is positioned inside the partial second polygon.

2. The stackable rebar chair of claim 1 wherein the less than all of the plurality of vertices includes a plurality of right angle vertices.

3. The stackable rebar chair of claim 2 wherein less than all of the plurality of vertices includes four right angle vertices.

4. The stackable rebar chair of claim 1 wherein the less than all of the plurality of vertices includes a plurality of concave vertices and a plurality of convex vertices.

5. The stackable rebar chair of claim 1 wherein each of the four vertically oriented support legs terminates at a corner line where a first slanted surface meets a second slanted surface, and the corner line is perpendicular to the vertical centerline.

6. The stackable rebar chair of claim 5 wherein each of the first slanted surface and the second slanted surface are oriented at respective angles with respect to the vertical centerline that are greater than zero and less than ninety degrees.

7. The stackable rebar chair of claim 1 wherein the partial second polygon is open on exactly one side that faces the vertical centerline.

8. The stackable rebar chair of claim 1 wherein each of the four vertically oriented leg receiving sockets have openings located higher on the vertical centerline than a respective low point of the first concave rebar cradle.

9. The stackable rebar chair of claim 1 wherein each of the four vertically oriented support legs defines a centerline that is parallel to the vertical centerline and intersects a region defined by a respective one of the partial second polygons.

10. The stackable rebar chair of claim 1 wherein the one-piece body includes a stiffening disc that is oriented perpendicular to the vertical centerline;

the four vertically oriented support legs extend in one direction away from the stiffening disc; and the four vertically oriented leg receiving sockets are located entirely on an opposite side of the stiffening disc.

11. A stack of stackable rebar chairs comprising:

a first rebar chair consisting of a one-piece body of molded plastic that defines a vertical centerline and includes four vertically oriented support legs, four vertically oriented leg receiving sockets that each have a cross section with a first shape, a first concave rebar cradle, and a second concave rebar cradle oriented perpendicular to the first concave rebar cradle;

a second rebar chair consisting of a one-piece body of molded plastic that defines a vertical centerline and includes four vertically oriented support legs that each have a cross section with a second shape which is different from the first shape, four vertically oriented leg receiving sockets, a first concave rebar cradle, and a second concave rebar cradle oriented perpendicular to the first concave rebar cradle;

the second rebar chair is mated to, supported by, and positioned directly atop the first rebar chair; and each of the four vertically oriented support legs of the second rebar chair is received in a respective one of the four vertically oriented leg receiving sockets of the first rebar chair; and a plurality of planar surfaces of each of the four vertically oriented support legs of the second rebar chair are in contact with respective planar surfaces that define portions of the respective one of the four vertically oriented leg receiving sockets of the first rebar chair.

12. The stack of stackable rebar chairs of claim 11 wherein one of the first and second stackable rebar chairs is taller than an other another of the first and second stackable rebar chairs.

13. The stack of stackable rebar chairs of claim 11 wherein each of the one-piece bodies includes a stiffening disc that is oriented perpendicular to the vertical centerline;

the four vertically oriented support legs extend in one direction away from one side of the stiffening disc; and the four vertically oriented leg receiving sockets are located entirely on an opposite side of the stiffening disc.

14. The stack of stackable rebar chairs of claim 11 wherein each of the four vertically oriented support legs of the first rebar chair are identical, and a cross section perpendicular to the vertical centerline defines a first polygon with twelve vertices;

wherein each of the four vertically oriented support legs of the second rebar chair are identical, and a cross section perpendicular to the vertical centerline defines a polygon with twelve vertices that is identical to the first polygon.

15. The A stack of stackable rebar chairs comprising:

a first rebar chair consisting of a one-piece body of molded plastic that defines a vertical centerline and includes four vertically oriented support legs, four vertically oriented leg receiving sockets, a first concave rebar cradle, and a second concave rebar cradle oriented perpendicular to the first concave rebar cradle;

a second rebar chair consisting of a one-piece body of molded plastic that defines a vertical centerline and includes four vertically oriented support legs, four vertically oriented leg receiving sockets, a first concave rebar cradle, and a second concave rebar cradle oriented perpendicular to the first concave rebar cradle;

the second rebar chair is mated to, supported by, and positioned directly atop the first rebar chair; and each of the four vertically oriented support legs of the second rebar chair is received in a respective one of the four vertically oriented leg receiving sockets of the first rebar chair; and a plurality of planar surfaces of each of the four vertically oriented support legs of the second rebar chair are in contact with respective planar surfaces that define portions of the respective one of the four vertically oriented leg receiving sockets of the first rebar chair;

each of the four vertically oriented leg receiving sockets of the first rebar chair is defined partially by a plurality of slanted surfaces that are slanted with respect to the vertical centerline; and each of the four vertically oriented support legs of the second rebar chair have counterpart slanted surfaces in contact with respective ones of the plurality of slanted surfaces of the first rebar chair.

16. The stack of stackable rebar chairs of claim 11 including a third rebar chair consisting of a one-piece body of molded plastic that includes four support legs, a first concave rebar cradle, and a second concave rebar cradle oriented perpendicular to the first concave rebar cradle;

wherein each of the four support legs is one of closer or further from the vertical centerline than each of the four vertically oriented support legs of both the second rebar chair and the first rebar chair; and the third rebar chair is mated to, supported by, and positioned directly atop the second rebar chair; and each of the four support legs of the third rebar chair is received in a respective one of the four vertically oriented leg receiving sockets of the second rebar chair.

17. The stack of rebar chairs of claim 16 including a fourth rebar chair consisting of a one-piece body of molded plastic that includes four support legs, a first concave rebar cradle, and a second concave rebar cradle oriented perpendicular to the first concave rebar cradle;

wherein each of the four support legs is another of closer or further from the vertical centerline than each of the four vertically oriented support legs of both the second rebar chair and the first rebar chair; and the fourth rebar chair is mated to, supported by, and positioned directly atop the second rebar chair; and each of the four support legs of the fourth rebar chair is received in a respective one of the four vertically oriented leg receiving sockets of the second rebar chair.

* * * * *